US005248963A

United States Patent [19]

Yasui et al.

[11] Patent Number: 5,248,963

[45] Date of Patent: Sep. 28, 1993

[54] METHOD AND CIRCUIT FOR ERASING A LIQUID CRYSTAL DISPLAY

[75] Inventors: Masaru Yasui; Noriyoshi Uenishi, both of Kobe, Japan

[73] Assignee: Hosiden Electronics Co., Ltd., Osaka, Japan

[21] Appl. No.: 839,298

[22] Filed: Feb. 26, 1992

Related U.S. Application Data

[63] Continuation of Ser. No. 391,600, filed as PCT/JP88/01308, on Dec. 23, 1988, abandoned.

[30] Foreign Application Priority Data

Dec. 25, 1987 [JP] Japan ..... 62-331764
Dec. 25, 1987 [JP] Japan ..... 62-331765

[51] Int. Cl.[5] ..... G09G 3/36; G09G 3/00

[52] U.S. Cl. ..... 345/98; 345/211; 345/214

[58] Field of Search ..... 307/38, 39, 31; 340/784, 805, 813, 814, 811, 771, 763; 358/236; 368/109; 365/227, 228; 364/707

[56] References Cited

U.S. PATENT DOCUMENTS

| | | | |
|---|---|---|---|
| 4,074,256 | 2/1978 | Sekiya | 340/763 |
| 4,365,290 | 12/1982 | Nelms et al. | 365/227 |
| 4,380,008 | 4/1983 | Kawakami et al. . | |
| 4,422,163 | 12/1983 | Oldenkamp | 365/229 |
| 4,511,926 | 4/1985 | Crossland et al. | 340/784 |
| 4,566,803 | 1/1986 | Waniisi et al. | 368/109 |
| 4,716,463 | 12/1987 | Stacy et al. | 365/227 |
| 4,803,480 | 2/1989 | Soneda et al. | 340/784 |
| 4,938,574 | 7/1990 | Kaneko et al. | 340/784 |

FOREIGN PATENT DOCUMENTS

| | | |
|---|---|---|
| 0035382 | 9/1981 | European Pat. Off. . |
| 0004853 | 1/1978 | Japan . |
| 0912297 | 7/1981 | Japan . |
| 61-162029 | 7/1986 | Japan . |
| 62-165630 | 7/1987 | Japan . |
| 0005792 | 1/1993 | Japan . |

OTHER PUBLICATIONS

Mano, M. Morris; Digital Design, 1984, pp. 263-268.

*Primary Examiner*—Alvin E. Oberley
*Assistant Examiner*—S. Saras
*Attorney, Agent, or Firm*—Pollock, Vande Sande & Priddy

[57] ABSTRACT

In the case of erasing a display on an active matrix type liquid crystal display which has a source bus drive circuit (16) and a gate bus drive circuit (17), pixel signals for turning OFF pixels of one row are applied to the source bus drive circuit, and at the same time, a clear signal (CL) is provided to the gate bus drive circuit (17), from which a voltage for turning ON transistors (13) provided in association with the respective pixels is applied to gate buses (15$_l$ through 15$_m$) all at once. A power holding circuit (22) is provided for holding power of an operating power supply ($V_1$) for a predetermined period of time after the power supply of the display is turned OFF, and a voltage drop detector (24) is provided for detecting the turning OFF of said power supply, and its detection signal is used to produce the clear signal (CL), which is provided to the gate bus drive circuit (17). The gate bus drive circuit responds to the clear signal to apply the voltage for turning ON the transistors (13) of the respective pixels to the gate buses all at once, thereby erasing the display in a short time after the turning OFF of the power supply.

5 Claims, 6 Drawing Sheets

FIG. 6A POW VOL $V_1$

FIG. 6B VOL DROP DET OUTPUT

FIG. 6C $V_1'$, $V_2'$, $V_F$, $V_{th}$

FIG. 6D INV OUTPUT $V_{CL}$

METHOD AND CIRCUIT FOR ERASING A LIQUID CRYSTAL DISPLAY

This application is a continuation of Ser. No. 07/391,600, filed as PCT/JP88/01308, on Dec. 23, 1988, now abandoned.

TECHNICAL FIELD

The present invention relates to a method and a circuit for erasing a display of an active matrix type liquid crystal display cell having a capacitive storage effect.

TECHNICAL BACKGROUND

A brief description will be given first, with reference to FIG. 1, of a typical prior art active matrix type liquid crystal display cell which has a capacitive storage effect. FIG. 1 shows a liquid crystal display panel 10 in which display pixels 12 are arranged in the form of a matrix (with m rows and n columns) and their display electrodes 12*a* are connected to drains of TFTs (Thin Film Transistors) 13, respectively. The TFTs 13 have their sources and gates connected to those of perpendicularly intersecting source buses $\mathbf{14}_l$ to $\mathbf{14}_n$ and gate buses 15 which correspond to them, respectively. The display pixels 12 each include a counter electrode (also referred to as a common electrode) 12*b* disposed opposite the display electrode 12*a*.

A source bus drive circuit 16 is provided for driving the source buses $\mathbf{14}_l$ through $\mathbf{14}_n$. From a main body (not shown) of the liquid crystal display device the source bus drive circuit is supplied with a pixel clock PCK, a horizontal synchronizing signal Hs and a control signal M for converting the power supply voltage into an AC form, such as shown in FIG. 2, and pixel data (a binary code representing logic "1" or "0") D which is applied in the horizontal direction in synchronism with the pixel clock PCK, though not shown. In the source bus drive circuit 16 the pixel data D of one row are sequentially loaded into a shift register 16*a* in synchronism with the pixel clock PCK, and in correspondence to the pixel data D, signals $S_l$ to $S_n$ to be displayed on the pixels of one row of the liquid crystal display panel 10 are ,simultaneously provided on the source buses $\mathbf{14}_l$ and $\mathbf{14}_n$ upon each occurrence of the horizontal synchronizing signal Hs. The signals $S_l$ to $S_n$ are also called source bus drive signals, and they have voltages $E_1$ and $E_2$ (in the case of a field $M=1$) or $E_2$ and $E_3$ (in the case of a field $M=0$) depending upon the logic "1" and "0" of the pixel data D, as shown in FIG. 2D in which one signal $S_j$ is exemplified. Here, $E_2=(E_1+E_3)/2$. The source bus drive circuit 16 operates on the DC voltages $E_1$, $E_2$ and $E_3$ and a common potential EG (zero volt) from the main body of the liquid crystal display device.

The liquid crystal display panel 10 is also supplied with the common potential EG from the main body of the display device and the counter electrodes of the respective pixels are each supplied with a voltage corresponding to the voltage $E_2$. The common potential EG (zero volt) and the voltages $E_1$, $E_2$ and $E_3$ are selected such that $E_1>EG>E_2>E_3$, for instance.

A gate bus drive circuit 17 drives the gate buses $\mathbf{15}_1$ to $\mathbf{15}_m$ high-level one after another upon each occurrence of the horizontal synchronizing signal Hs, thereby turning ON the TFTs of one row from the first to the mth row in a sequential order. As a result of this, the source bus drive signals $S_l$ to $S_n$ are applied to the corresponding pixels, respectively. The gate bus drive circuit is made up principally of an m-stage shift register 18 and a gate bus driver 19. A vertical synchronizing signal Vs (FIG. 2E) is applied, as a start signal, to a data terminal D of the first-stage shift register, and the horizontal synchronizing signal Hs is applied to a clock terminal CK of each stage. Pulses, which result from sequential delaying of the start signal for the horizontal synchronizing signal period, are provided from output terminals Q of the respective stages to the gate bus driver 19. In the gate bus driver 19 the input pulses are converted in level, providing on the gate buses $\mathbf{15}_l$ to $\mathbf{15}_m$ gate bus drive signals $G_l$ to $G_m$ (FIG. 2F) each of which has a voltage level $V_1$ or $V_3$ depending on whether the input pulse from the corresponding stage is high- or low-level. From the main body of the device the power supply voltages $V_1$ and $V_2$ are supplied to the shift register 18 and the gate bus driver 19 and the power supply voltage $V_3$ is supplied to the gate bus driver 19. These voltages are selected such that $V_1>V_2>V_3$, and in many cases, $V_1-V_2=5$ volts.

To clear a display at a desired time, pixel data for one field (m rows) which have logic "0" for erasing displays of respective pixels are provided from the main body of the device, and upon each occurrence of the horizontal synchronizing signal Hs, voltage $E_2$ signals for m rows are simultaneously applied from the source bus drive circuit 16 to the source buses $\mathbf{14}_l$ through $\mathbf{14}_n$ and the gate buses $\mathbf{15}_l$ through $\mathbf{15}_m$ are sequentially driven high-level by the gate bus driver 17, whereby the display of one field is cleared. That is, clearing of one field display needs a time $mT_H$ (where $T_H$ is the cycle of the horizontal synchronizing signal) at the shortest. This is not preferable because, for example, when the liquid crystal display panel 10 is used with a computer, the higher the display-clearing frequency, the longer the time for which the computer is occupied.

To stop the display device from the display operation, it is customary to turn OFF the power supply switch of the display device main body without involving any particular display clearing operation mentioned above. Upon turning OFF the switch, various signals provided to the liquid crystal display panel disappear and various power supply voltages also drop to the common potential (the ground potential) within a short time. The output $G_i$ of the gate bus driver also disappears and drops to the common potential. Consequently, all the TFTs 13 of the liquid crystal display panel 10 are turned OFF, and charges stored in pixel capacitances remain undischarged for a relatively long period of time, because their external discharge paths are cut off. This allows residual images to remain on the display screen, impairing the display quality. Furthermore, to leave the pixels stored with charges as mentioned above means that DC voltage remains unremoved from the liquid crystal, shortening its life and lowering its reliability.

An object of the present invention is to provide a liquid crystal display erasing method which permits clearing of a display on a liquid crystal display panel in a markedly shorter time than in the past.

Another object of the present invention is to provide a liquid crystal display erasing circuit which permits clearing of a residual image in a short time upon turning OFF the power supply of a display device and prevents shortening of liquid crystal life and lowering of its reliability.

SUMMARY OF THE INVENTION

According to the present invention, in the case of clearing a display image on a' liquid crystal display panel, pixel data for clearing the display, corresponding to display elements of one row, is applied to a source bus drive circuit, by which all source buses are simultaneously driven to the voltage level corresponding to the above-mentioned pixel data for a predetermined period of time, during which all outputs of a gate bus drive circuit are simultaneously held at an active level by an erasing signal.

Furthermore, according to the present invention, a power holding circuit is provided for holding power of the operating power supply to the gate bus drive circuit for a predetermined period of time after turning OFF of the power supply of the display device. Moreover, means is provided for detecting the turning OFF of the power supply of the display device, and by its detecting signal, the outputs of the gate bus drive circuit are simultaneously held at the active level for a predetermined period of time.

DESCRIPTION OF THE PREFERRED EMBODIMENTS

Figure 1:
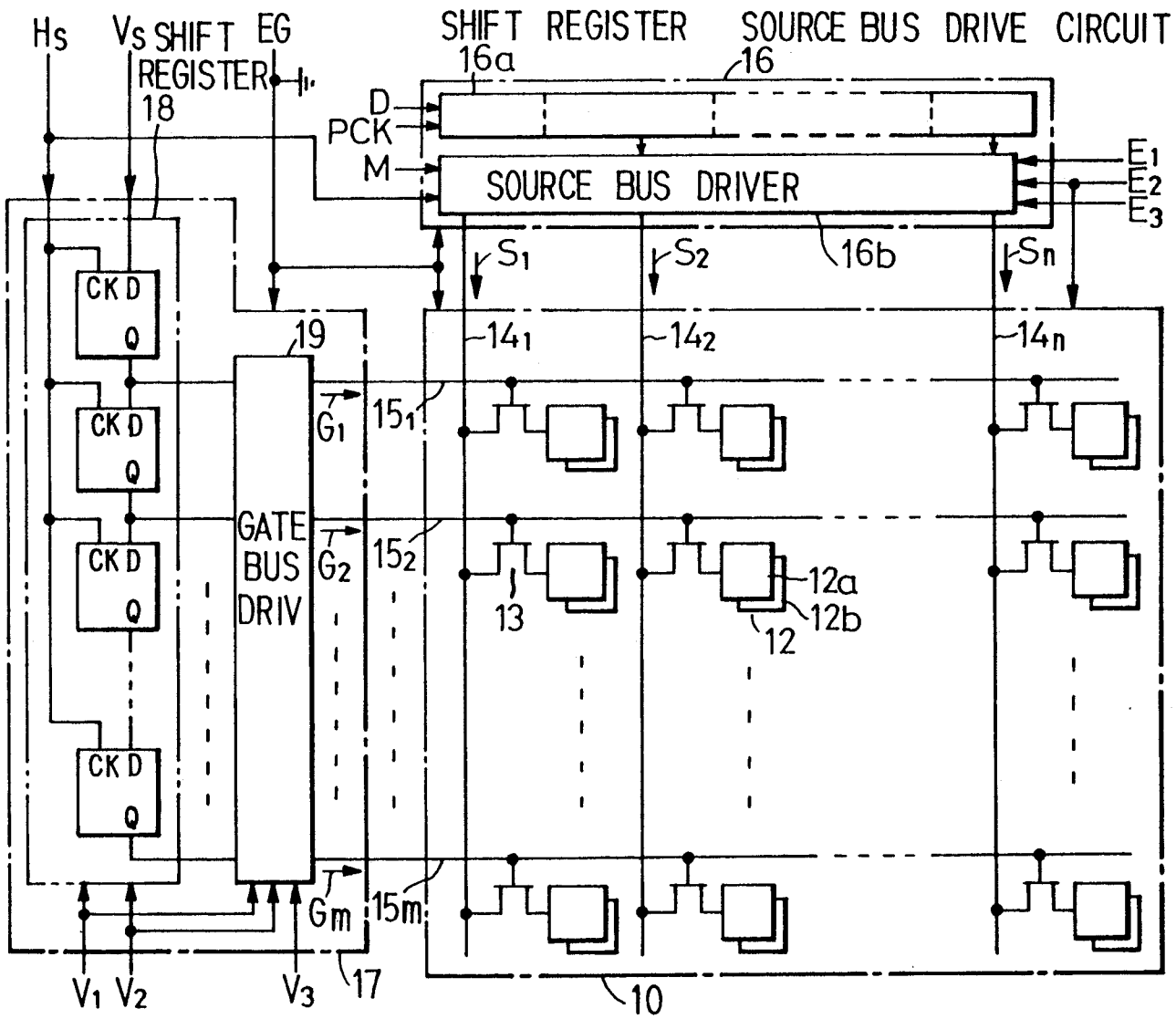
FIG. 1 is a diagram for explaining the arrangement of conventional active matrix type liquid crystal display elements.
Figure 2:
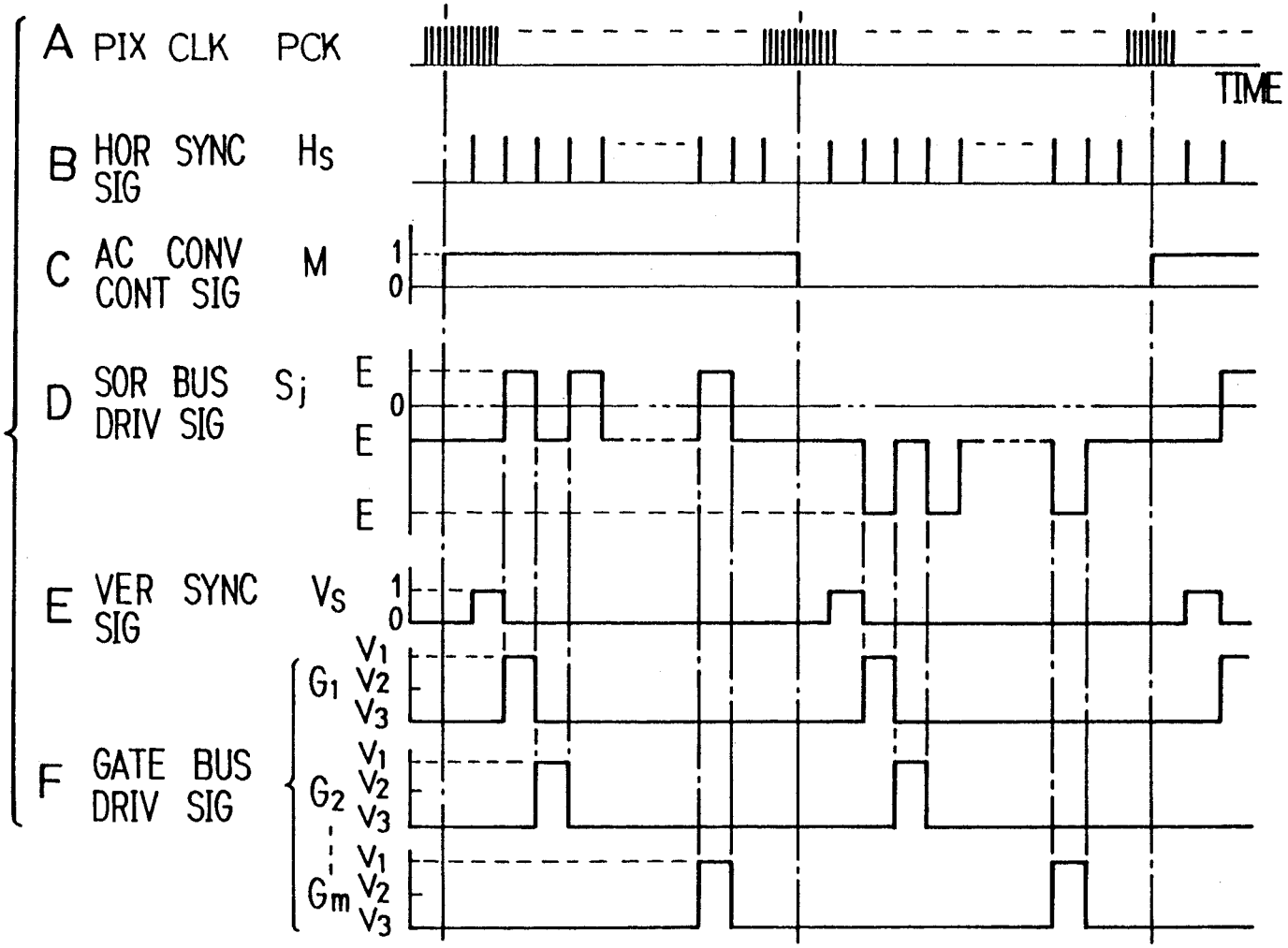
FIGS. 2A–2F are waveform diagrams for explaining the operation of the display elements shown in FIG. 1.
Figure 3:
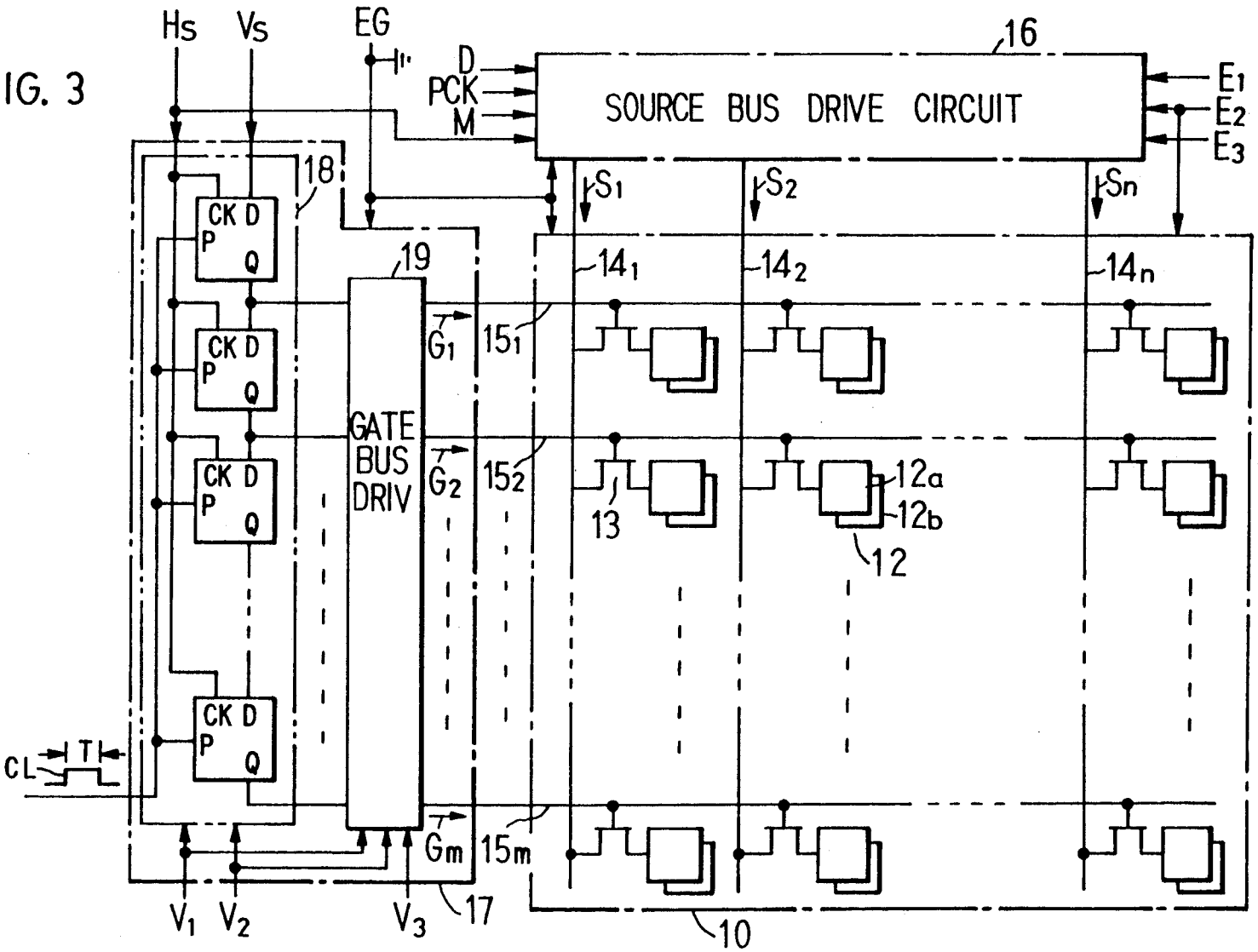
FIG. 3 is a diagram illustrating the arrangement of liquid crystal display elements embodying the liquid crystal display erasing method of the present invention.

In FIG. 3 there is shown an embodiment of the present invention as being applied to the liquid crystal display elements of FIG. 1; the parts corresponding to those in FIG. 1 are identified by the same reference numerals and no detailed description will be given of them. The source bus drive circuit 16 and the liquid crystal display panel 10 are identical with those in FIG. 1. In the embodiment of FIG. 3, the shift register 18 in the gate bus drive circuit 17 is made up of cascade-connected presettable D-type flip-flops, which are adapted so that their preset terminals P can be supplied with a clear signal CL at the same time. The clear signal CL is created in accordance with an operator's instruction or under control of a program in a computer connected to the display device. According to the present invention, in the case of clearing a display image, pixel data D of logic "0" for clearing the display, corresponding to one row of the display panel 10, is provided to the source bus drive circuit 16, from which source bus drive signals $S_l$ through $S_n$ of voltage corresponding to the above-mentioned pixel data, i.e. voltage $E_2$ equal to the voltage of the common electrodes 12*b*, are simultaneously applied to the source buses $\mathbf{14}_l$ through $\mathbf{14}_n$ within one horizontal synchronization cycle. In synchronization with this, the clear signal CL is provided to the preset terminal P of each stage of the shift register 18 in the gate bus drive circuit 17 as depicted in FIG. 3. The duration T of the clear signal CL needs only to be equal to or longer than one cycle of the horizontal synchronizing signal Hs. Upon application of the clear signal Hs, the Q output of each stage of the shift register 18 goes to a high level for the time T and the outputs $G_l$ through $G_m$ of the gate bus driver 19 also go to the high level. (In general, this level needs only to be high enough to activate the TFTs 13 of the liquid crystal display panel 10.) Thus all the TFTs 13 are simultaneously rendered ON during the time T. Consequently, the source bus drive signals $S_l$ through $S_n$ for clearing the display are supplied to all pixels with m rows and n columns, by which display images are cleared all at once within the time T.

Figure 4:
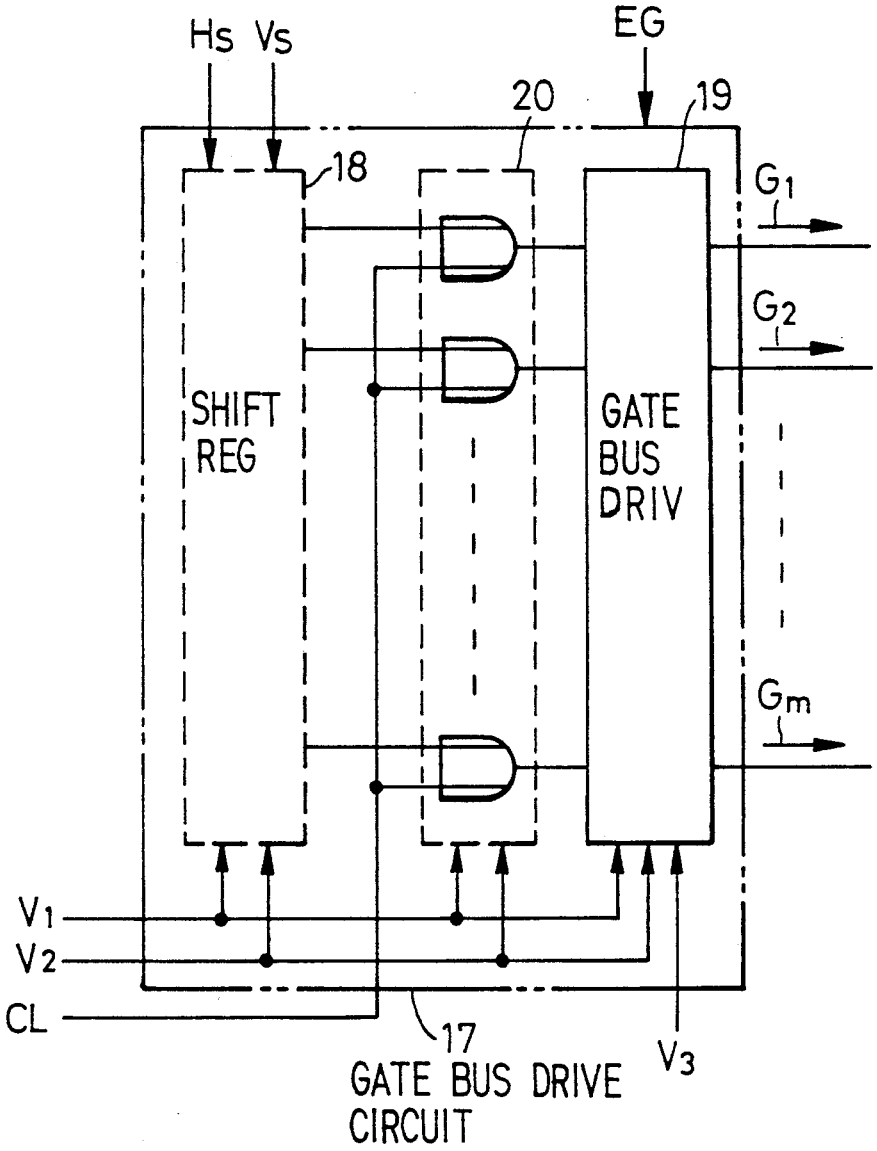
FIG. 4 is a block diagram illustrating a modified form of a gate bus drive circuit 17 in FIG. 3.

FIG. 4 illustrates another embodiment of the present invention, in which an OR circuit 20 is provided between the shift register 18 and the gate bus driver 19 in the gate bus drive circuit 17 in FIG. 1. Each OR gate of the OR circuit 20 is supplied at one input with the output of the corresponding stage of the shift register 18 and at the other input with the clear signal CL, and the output of each OR gate is applied to the gate bus driver 19. The gate bus driver 19 yields high-level signals $G_l$ through $G_m$ all at once during the duration T of the input clear signal CL. Consequently, display images can be cleared all over the display screen within one cycle of the horizontal synchronizing signal Hs as is the case with the embodiment shown in FIG. 3. The source bus drive circuit 16 and the display panel 10 are identical with those in FIG. 1, and hence are not shown.

Figure 5:
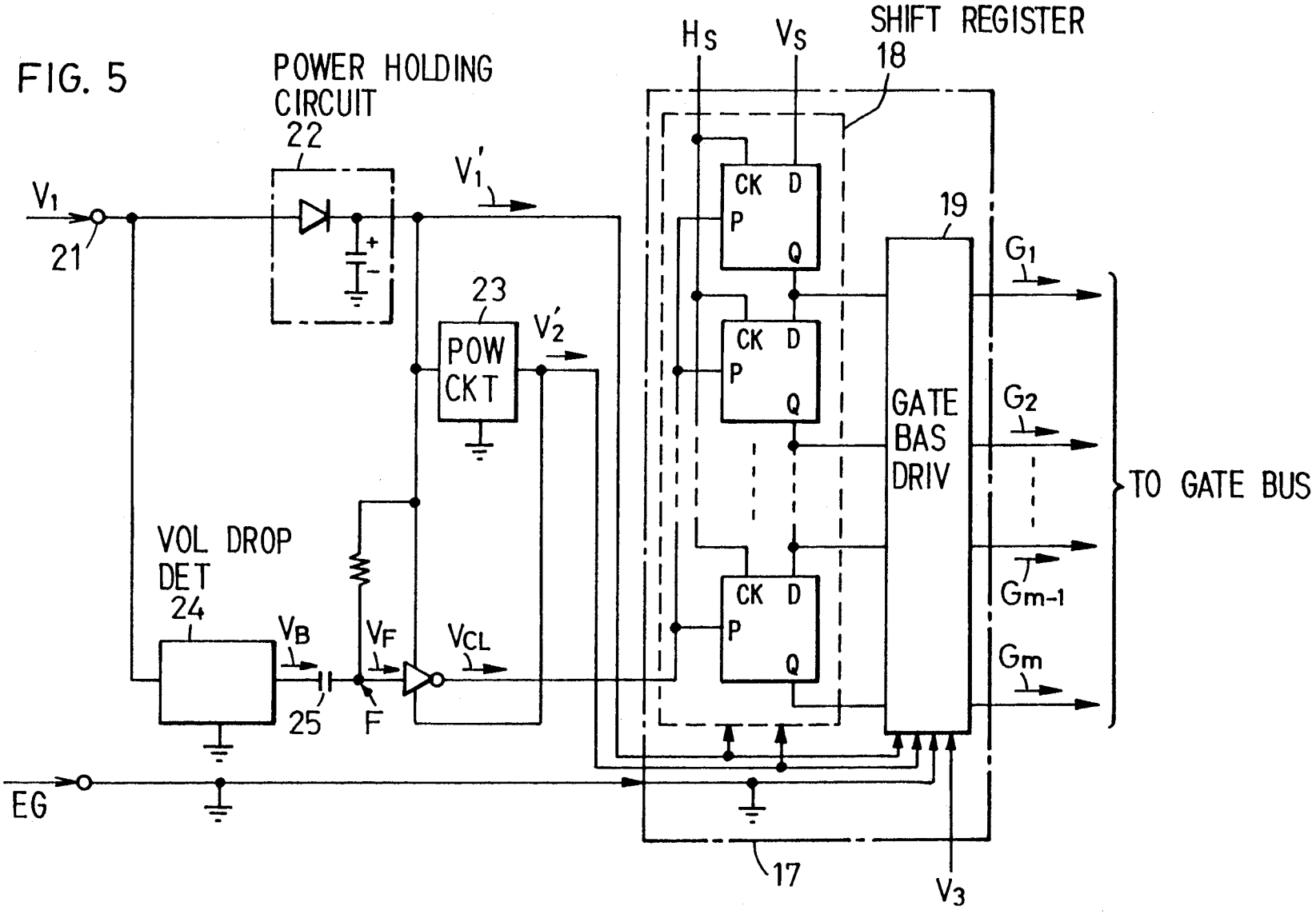
FIG. 5 is a block diagram illustrating a display erasing circuit according to another embodiment of the present invention.

FIG. 5 illustrates another embodiment of the present invention in which the clear signal CL in the embodiment of FIG. 1 is produced upon turning OFF of the power supply of the display device main body. The source bus drive circuit 16 and the liquid crystal display panel 10 are identical with those in FIG. 1, and hence are not shown.

In this embodiment, as shown in FIG. 5, when the liquid crystal display elements are in operation, that is, when the power supply of the display device main body is ON, a large-capacity capacitor 22*b* is charged via a diode 22*a* with the power supply voltage $V_1$ (which is the same as the voltage $V_1$ in the prior art example depicted in FIG. 1) which is applied from the liquid crystal display device main body to a terminal 21, and at the same time, the voltage $V_1$ is provided to the gate bus drive circuit 17. The diode 22*a* and the capacitor 22*b* constitute a power holding circuit 22 which holds and supplies power to a load for a predetermined period of time after turning OFF of the power supply of the display device main body. If it is disadvantageous that the output voltage $V_1'$ of the power holding circuit drops below the input voltage $V_1$, it is also possible to increase the input voltage $V_1$ in compensation for the voltage drop or provide a DC-DC converter at the input side of the power holding circuit 22 for boosting the input voltage. The output of the power holding circuit 22 is also applied to a power circuit 23, wherein a voltage $V_2'$ is created as a substitute for the source voltage $V_2$ which is supplied from the device main body in the prior art, and the voltage $V_2'$ is provided to the gate bus drive circuit 17. Other voltages are the same as those used in the prior art example. That is, the gate bus drive circuit 17 is supplied with the voltage $V_3$ (which is a low-level voltage of the gate bus drive signal $G_i$ and is used to turn OFF the TFT 13), and though not shown, the source bus drive circuit 16 is supplied with voltages $E_1$, $E_2$ and $E_3$ from the display device main body and the counter electrodes 12b of the liquid crystal display panel 10 are supplied with the voltage $E_2$. The supply of these voltages $V_1$, $V_3$, $E_1$, $E_2$ and $E_3$ is stopped when the power supply of the display device main body is turned OFF.

Figure 6:
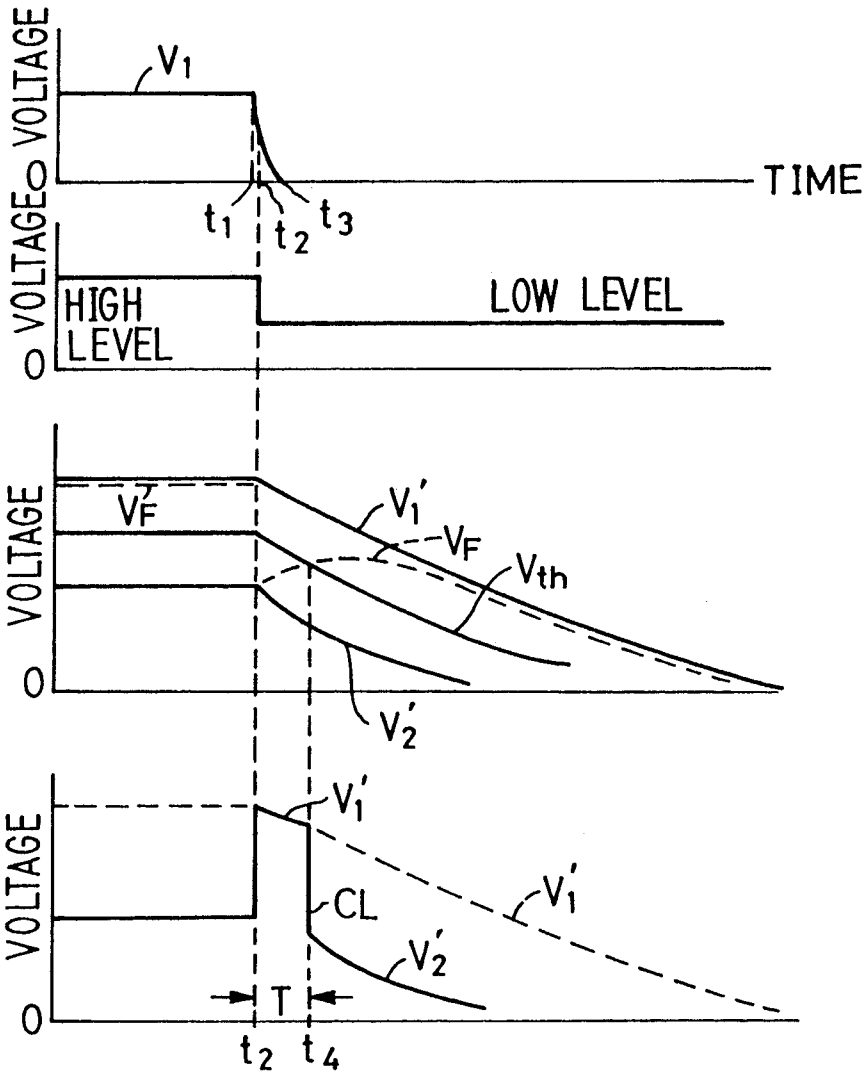
FIGS. 6A–6D are voltage waveform diagrams for explaining the operation of the erasing circuit depicted in FIG. 5.

Now, assuming that the power switch of the display device main body is turned OFF at a time $t_1$, the voltage $V_1$ drops to zero volts (the common potential) at a time $t_3$ (FIG. 6A). The output voltage $V_1'$ of the power holding circuit 22 gradually decreases with a large time constant $C_{22}RL$ (where $C_{22}$ is the capacitance of the capacitor 22b and $R_L$ is the load resistance of the power holding circuit 22) (FIG. 6C). On the other hand, the voltage drop of the voltage $V_1$ is detected by a voltage drop detector 24, and at a time point $t_2$ when the voltage $V_1$ has dipped, for instance, 20% below a reference value, the voltage drop detector 24 changes to a low level its output $V_B$ held at a high level until then (FIG. 6B). The output $V_B$ of the voltage drop detector 24 is applied to the output side of the power holding circuit 22 via a capacitor 25 and a resistor 26. The junction F between the capacitor 25 and the resistor 26 is connected to an input terminal of an inverter 27. The voltage $V_F$ at the junction F drops at the time $t_2$ and then gradually approaches, with a time constant CR (where C and R are the capacitance of the capacitor 25 and the resistance of the resistor 26, respectively), the output voltage $V_1'$ of the power holding circuit 22 (FIG. 6C).

To the inverter 27 are applied, as its operating voltages, the voltages $V_1'$ and $V_2'$. After the time point $t_2$ the voltage $V_2'$ also drops to the common potential with a gradually decreasing time constant, together with the voltage $V_1'$. Since the threshold level $V_{th}$ of the inverter 27 is set to a level intermediate between the voltages $V_1'$ and $V_2'$ as depicted in FIG. 6C, the inverter 27 yields a high-level output $V_{CL}$ as the clear signal for a period of time T ($t_2-t_4$) during which the input voltage $V_F$ to the inverter 27 is lower than the threshold level $V_{th}$ (FIG. 6D). The waveform of the output $V_{CL}$ from the inverter 27 is substantially the same as that of the voltage $V_1'$ in the time interval between $t_2$ and $t_4$ but is nearly equal to the waveform of the voltage $V_2'$ except that time interval. The pulse width T of the output clear signal CL from the inverter 27 is set to a value a little greater than the time during which the voltages $E_1$, $E_2$, $V_1$ and $V_3$ supplied to the liquid crystal display panel drop to the common potential when the power supply is turned OFF. That is, $T>(t_3-t_1)$ The output clear signal CL from the inverter 27 is applied to the preset terminal P of each stage of the shift register 18, and the Q output from each stage is rendered high-level (nearly equal to the voltage $V_1'$) during the time T, and consequently, the outputs $G_l$ through $G_m$ of the gate bus driver 19 are also made high-level (which level needs only to be high enough to activate or turn ON the TFTs 13, substantially equal to the voltage $V_1'$ in this instance). All the TFTs 13 of the liquid crystal display panel 10 described previously in conjunction with the prior art example are simultaneously turned ON during the time T, and consequently, the display electrode 12a of each pixel 12 is electrically connected via the TFT to the source bus driver 16b. The source bus driver 16b is arranged so that the potential at its output terminal goes to the common potential EG at substantially the same time as the operating voltages $E_1$, $E_2$ and $E_3$ drop to the common potential. That is, the source bus driver is designed so that the source bus driver signals $S_l$ through $S_n$ drop to the common potential within the time T. The display electrode 12a and the counter electrode 12b (the latter being supplied with the voltage $E_2$) are both supplied with the common potential within the time T, and charges stored in each pixel capacitance in accordance with the display being provided are entirely discharged by the end of the time T. In other words, the time T includes the time necessary for discharging the charges stored in the pixel capacitances.

It is evident that the gate bus drive circuit 17 in FIG. 5 may also be replaced with the circuit shown in FIG. 4. While the source bus drive circuit 16 in FIG. 3 has been described to drive the source buses $\mathbf{14}_l$ through $\mathbf{14}_n$ in such a manner as to provide a binary or ON-OFF display in response to a binary pixel signal as is the case with the prior art example shown in FIG. 1, it is also easy for those skilled in the art to construct the source bus drive circuit 16 so that a half tone display may be provided using an analog video signal which has a half tone pixel level.

As described above, according to the present invention, display images can be cleared within one cycle of the horizontal synchronizing signal, which is as short as 1/m (where m is the number of rows forming the display screen) of the one-field time needed in the past. Consequently, the display panel of the invention, when used as a display of a computer, is very advantageous in that the time for which the computer is occupied for clearing display images can be reduced accordingly.

Moreover, according to the present invention, the turning OFF of the power supply of the liquid crystal display device is automatically detected and the detection signal is used to hold the TFTs of the liquid crystal display elements in the ON stage for a predetermined period of time so that charges stored in the pixel capacitances can be discharged in a short time. This ensures clearing of residual images in a short time and prevents the reduction of the life of the liquid crystal and lowering of its reliability.

What is claimed is:

1. A liquid crystal display erasing circuit for erasing a liquid crystal display device more quickly and without affecting the life or reliability of elements forming said display device, said liquid crystal display device comprising an active type matrix liquid crystal display panel having transistors respectively connected to pixels arranged in a row and column matrix, a source bus drive circuit responsive to a source voltage from a power supply for driving source buses connected to the source electrodes of said transistors of respective matrix columns, and a gate bus drive circuit for driving gate buses connected to the gate electrodes of said transistors of respective matrix rows, said erasing circuit comprising:

power holding means supplied with said source voltage for holding power for a predetermined period of time after said power supply is turned OFF, said gate bus drive circuit being supplied with an operating voltage via said power holding means from said power supply;

power drop detecting means responsive to the turning OFF of said power supply for generating a detection output;

clear signal generating means responsive to said detection output for generating a clear signal immediately after generation of said detection output; and, all gate bus select means operative to provide said clear signal to said gate bus drive circuit for causing said gate bus drive circuit to simultaneously supply all of said gate buses with a voltage that turns ON all of said transistors simultaneously to discharge all the pixels connected thereto immediately after the turning OFF of said power supply.

2. The liquid crystal display erasing circuit of claim 1, wherein said gate bus drive circuit includes a shift register comprised of a plurality of cascade-connected D-type flip-flops operative to shift one stable state along said flip-flops in synchronization with a horizontal synchronizing signal, and a plurality of gate drivers for driving said gate buses in accordance with outputs from respective output stages of said shift register, and wherein said all gate bus select means is connected in common to preset terminals of said D-type flip-flops and responds to said clear signal to simultaneously preset all of said D-type flip-flops.

3. The liquid crystal display erasing circuit of claim 2, wherein said gate bus drive circuit includes a shift register composed of a plurality of cascade-connected D-type flip-flops operative to shift one stable state along said flip-flops in synchronization with a horizontal synchronizing signal, and a plurality of gate drivers for driving said gate buses in accordance with outputs from respective output stages of said shift register, and wherein said all gate bus select means is connected to inputs of said gate drivers and simultaneously applies said clear signal to all of said gate drivers.

4. The liquid crystal display erasing circuit of claim 2 or 3, wherein said power holding means includes a diode connected in its forward direction to said power supply, and a capacitor connected to the cathode of said diode for storing a fixed amount of power supplied from said power supply.

5. The liquid crystal display erasing circuit of claim 2 or 3, wherein said clear signal generating means includes means for detecting a drop of voltage supplied from said power supply, and means responsive to, the output voltage from said power holding means for generating a signal for a substantially fixed period of time after the voltage drop detected by said voltage drop detecting means.

* * * * *